US006336418B1

(12) United States Patent
Pavlovic

(10) Patent No.: US 6,336,418 B1
(45) Date of Patent: Jan. 8, 2002

(54) FOOTSTRAP

(75) Inventor: Mica Pavlovic, Shatin (HK)

(73) Assignee: Mistral Sports Group SA, Fribourg (CH)

( * ) Notice: Subject to any disclaimer, the term of this patent is extended or adjusted under 35 U.S.C. 154(b) by 0 days.

(21) Appl. No.: 09/362,876

(22) Filed: Jul. 29, 1999

(30) Foreign Application Priority Data

Jul. 31, 1998 (DE) ..... 198 34 639

(51) Int. Cl.[7] ..... B63B 35/79; B63H 9/00
(52) U.S. Cl. ..... 114/39.19; 441/74
(58) Field of Search ..... 114/39.19, 364; 441/61–74

(56) References Cited

U.S. PATENT DOCUMENTS 4,592,734 A * 6/1986 Metiver ..... 441/74
4,775,345 A 10/1988 Gifford
4,846,744 A * 7/1989 Love ..... 441/75
4,871,337 A 10/1989 Harris
4,889,510 A * 12/1989 Piatt ..... 441/63
5,125,859 A * 6/1992 Spurgeon ..... 441/75
5,148,761 A * 9/1992 Winner ..... 114/39.15
5,997,375 A * 12/1999 Vukelic et al. ..... 441/70

FOREIGN PATENT DOCUMENTS

| | | |
|---|---|---|
| DE | 80 01 246 | 5/1980 |
| DE | 31 04 412 A1 | 8/1982 |
| DE | 35 34 376 A1 | 4/1987 |
| EP | 0 369 982 A1 | 10/1989 |
| GB | 2 178 297 A | 2/1987 |

OTHER PUBLICATIONS

"Fanatic Schlaufen," Fanatic Schutzwerke, Selters, Oct. 1988.

* cited by examiner

*Primary Examiner*—S. Joseph Morano
*Assistant Examiner*—Andrew Wright
(74) *Attorney, Agent, or Firm*—Oliff & Berridge, PLC

(57) ABSTRACT

A footstrap in which a portion bridging the foot of a surfer is pre-shaped such that the footstrap contacts the entire area of the foot with regular distribution of pressure.

7 Claims, 5 Drawing Sheets

FOOTSTRAP

The invention relates to a footstrap for sports appliances, in particular for a sailboard according to the preamble of patent claim 1.

Footstraps of this kind are for instance fastened on the standing face of sailboards to convey better standing to the surfer. As a rule, one or two rear footstraps are fastened approximately in the central longitudinal axis of the board, and two front footstraps laterally displaced towards the respective marginal areas of the sailboard are provided. The footstraps are fastened by means of footstrap plugs in the core of the sailboard, the footstraps extending, starting out from fastening portions, upwards in the form of a bow, so that the surfer can slide his foot in the respective footstrap. A problem is that, in particular in the case of strong wind, substantial forces have to be transferred via the footstraps to keep the sailboard under control, so that bruises may occur on the surfer's feet in the case of extreme maneuvers.

Accordingly, it is an object of the invention to provide a footstrap which guarantees an optimum of surfing comfort even with extreme surfing conditions.

This object is solved by a footstrap comprising the features of patent claim 1.

By the measure of providing the footstrap with a foot strap portion that is inclined to match the anatomy of the foot or, more exactly speaking, the foot's instep, full contact of the footstrap with the foot is guaranteed, so that bruises can be avoided. In the case of conventional solutions, bruises occurred since the footstraps' width and height were adapted only coarsely to the foot's shape while the symmetrical bending of the footstraps on the board's surface did not take into account the inclination of the foot's instep. Due to the full contact, the footstraps furthermore are stressed more regularly, so that selective overstressing of the footstrap fixtures is almost excluded.

Another advantage of the solution according to the invention consists in that the control force can better be transferred to the board in maneuvers due to the full contact with the foot, which facilitates the performing of extreme maneuvers.

From an ergonomic point of view, the footstrap is configured particularly advantageously when the contact face of the footstrap element is inclined or convex both in the longitudinal direction of the foot and in the transverse direction of the foot.

A particularly good adaptation to the foot is obtained when the footstrap is configured asymmetrically, so that it rises in a first portion relatively steeply from the standing face of the sailboard end, after achieving a maximum, drops with less gradient towards the other fastening portion. Thus, the cross-section of the natural foot shape is resembled very much. The profile of the footstrap is configured such that it tapers towards the front (foot tip) to match the longitudinal inclination of the foot's instep.

The occurring of bruises can further be reduced when the footstrap portion is provided with a padded portion which maintains its dimensional stability by means of an insert. This insert extends over the padded portion.

The handling of the footstrap pursuant to the invention is particularly simple when the insert is configured in two parts with two supporting straps, wherein in a middle portion of the two supporting strap portions overlapping each other a clasp may be provided, so that the width of the footstraps can be adjusted to the width of the foot. The width and height of the footstrap may also be adjusted by an own fixing means, for instance a fixing belt extending over the supporting straps.

The padded portion is preferably manufactured from a foamed elastomer, and the supporting strap extending over the padded portion is preferably manufactured from a relatively dimensionally stable, moldable material.

The oblique inclination of the padded portion for adaptation to the foot's outer contour may be predetermined or else may be determined by the corresponding configuration of the supporting element. The inclination of the padded portion may also be predetermined by suitable stitching of the supporting element with the padded portion.

The fastening portions are configured such that an adaptation to the foot's width is possible.

Other advantageous developments of the invention are the subject matter of the further subclaims.

In the following, preferred embodiments of the invention are explained in detail by means of schematic drawings.

Figure 1:
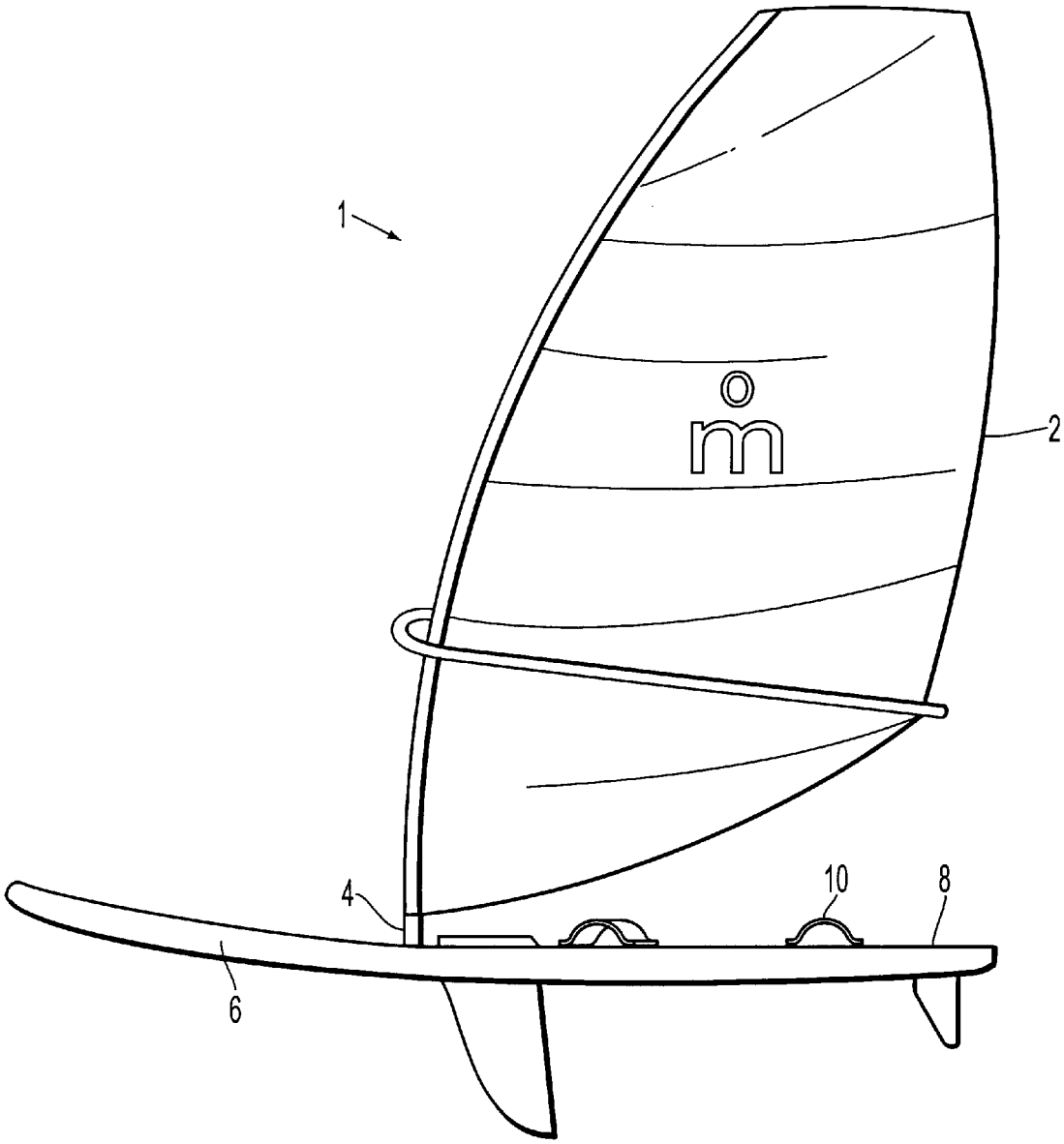
FIG. 1 shows a schematic view of a sailboard equipped with straps pursuant to the invention.

FIG. 1 shows a schematic illustration of a sailboard 1 comprising a rigging 2 fastened to a board 6 by means of a mast foot 4. On a standing face 8 of the board 6 footstraps 10 are fastened for improving a surfer's stability. In most cases, four footstraps 10 are fastened to the standing face 8, and it is merely the two luff-side footstraps 10 that are used while the lee-side footstraps 10 remain free.

Since the average abilities of the surfers have meanwhile achieved a substantial level, average surfers also are capable of doing radical maneuvers. These require an exact adaptation of the footstraps 10 to the respective foot geometry, to ensure that the control impulses can be transferred to the board 6 without losses and the forces are transferred to the entire face of the foot.

The requirement to be met now consists in that the footstraps 10 are, on the one hand, wide enough for the surfer to slide his foot into them or pull it out of them without problems. On the other hand, the footstraps have to surround the foot strongly enough to enable maneuvers to be done with the desired accuracy.

Figure 2:
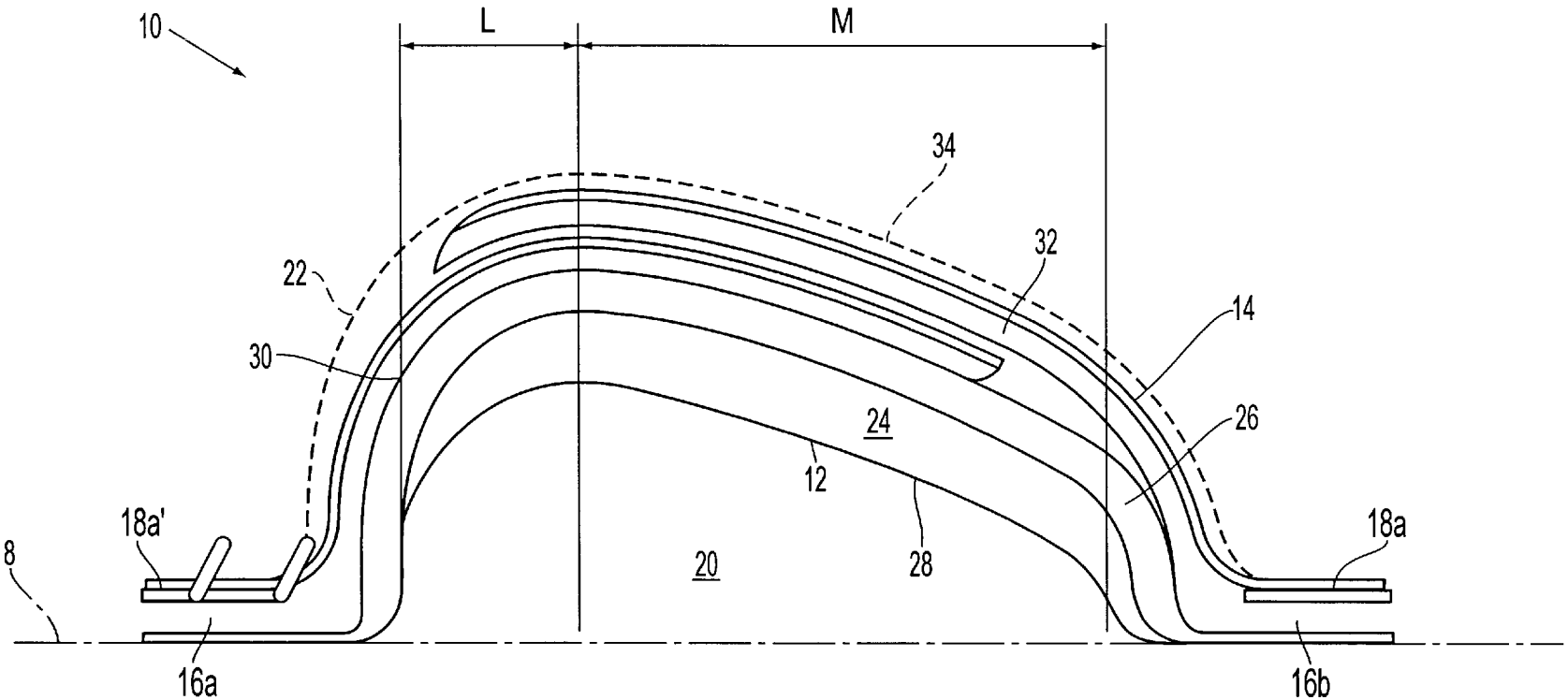
FIG. 2 shows a sectional illustration of a footstrap pursuant to the invention for a sailboard according to FIG. 1.

FIG. 2 shows a longitudinal view through a footstrap 10 as it may be used with the board 6 illustrated in FIG. 1.

The footstrap 10 pursuant to the invention is fastened to the standing face 8 of the sailboard 6 by means of footstrap plugs which are not shown.

The footstrap 10 is of multi-layer construction comprising a padded portion 12 adjacent to the foot of the surfer and an insert 14 substantially determining the stability of the footstrap 10.

In the embodiment shown in FIG. 2, the padded portion 12 is provided merely at the lower, foot-side portion of the footstrap 10.

In an alternative variant, the padded portion 12 may also surround the entire footstrap like a hose. This wrapping may be opened by a suitable clasp, for instance a velcro fastening, in order to provide access to the inner layers of the footstrap 10.

The multi-layer construction consisting of padded portion 12 and insert 14 comprises two fastening portions 16*a*, 16*b*, by means of which the footstrap 10 is in contact with the standing face 8. For reinforcement, the fastening portions 16*a*, 16*b* are provided with assembly plates 18*a*, 18*b* which are interspersed by the screws anchored in the footstrap plugs. From the two fastening portions 16*a*, 16*b* a footstrap portion 22 extends upwards (illustration according to FIG. 2), so that an entrance opening 20 for the foot of the surfer is formed by the standing face 8 and the footstrap 10.

As may be gathered from the illustration according to FIG. 2, the footstrap 10 rises from the inner foot-side fastening portion 16*a* relatively steeply to a maximum height and then drops from there at relatively little gradient towards the outer foot-side fastening portion 16*b*.

The highest point of the entrance opening 20 is displaced inwardly by a distance L from the inner foot-side fastening portion 16*a* and by the measure M from the outer foot-side fastening portion 16*b*. Corresponding to the foot's geometry, the distance L is substantially smaller than the distance M, so that an asymmetrical profile is formed. As a rule, the distance L will amount to less than half of the distance M.

As may furthermore be gathered from FIG. 2, the footstrap 10 is configured asymmetrically also in the direction perpendicular to the drawing plane. FIG. 2 shows the footstrap 10 from the direction from which the surfer's foot is slid in. Correspondingly, the contact face 24 of the padded portion 12 drops rearwardly from the front side edge 26 of the padded portion 12 directed towards the observer to the rear side edge 28 turned away from the observer, so that the inside width of the opening 20 decreases from the front edge 26 towards the rear edge 28. The inclination of the contact face 24 is adapted to the inclination of the front foot (instep), so that a contact over the entire face is guaranteed.

By the measures described before, i.e. the adaptation of the footstep shape in transverse direction (transverse to the foot entrance direction) and in longitudinal direction (parallel to the entrance direction) to the foot's geometry, an optimum footstrap 10 is obtained from an ergonomic point of view, which guarantees for contact over the entire face at a minimum of pressure stress.

In the embodiment illustrated in FIG. 2, this three-dimensional oblique inclination and curvature of the contact face 24 can be adapted to varying foot widths. This is achieved by the fact that the insert 14 is configured by two supporting straps 30, 32, the two end portions of which are overlapping each other. According to FIG. 2, the supporting strap 30 extends beyond the maximum marked by the distance L and terminates at a distance to the outer foot-side fastening portion 16*b*. Correspondingly, the supporting strap illustrated at the right in FIG. 2 extends from the fastening portion 16*b* beyond the maximum (distance M) and terminates at a distance to the inner foot-side fastening portion 16*a*. The supporting straps 30, 32 are manufactured from a plastic material resistant to bending, for instance by injection molding. The padded portion 28 is preferably manufactured from a foamed elastomer, e.g. Neoprene.

By the overlapping of the free end portions of the two supporting straps 30, 32, sufficient dimensional stability is ensured, so that the contact face 24 can be configured in the predetermined shape. The two resilient supporting straps 30, 32 substantially automatically adjust themselves to the foot cross-section of the surfer. In order to prevent excessive moving apart of the free end portions of the supporting straps 30, 32, the footstrap 10 may be provided with a fixing belt 34 shown in dotted line, which extends over the insert 14 from the one fastening portion 16*b* to the other fastening portion 16*a*. For adjusting the overlapping area of the two free end portions of the supporting straps 30, 32, the fixing belt 34 may be provided with a suitable adjusting mechanism. This may be effected by two swivellingly mounted D-rings 37 spaced apart from each other, which are, in a well-known manner, embraced by a free end portion of the supporting belt. Similar clasps are for instance common with chinstraps for motorbike helmets. The other end portion of the fixing belt then is fixed in the area of the outer foot-side fastening portion 16*b*.

The profile of the footstrap 10 may also be determined by suitable assembling of the elements, for instance by stitching up the fixing belt 34 with the padded portion 12 of a belt band.

In order to prevent inadvertent loosening of the fixing belt 34, it may, in deviation from the embodiment shown, also be surrounded by a padded portion 12 in the form of a hose.

Figure 3:
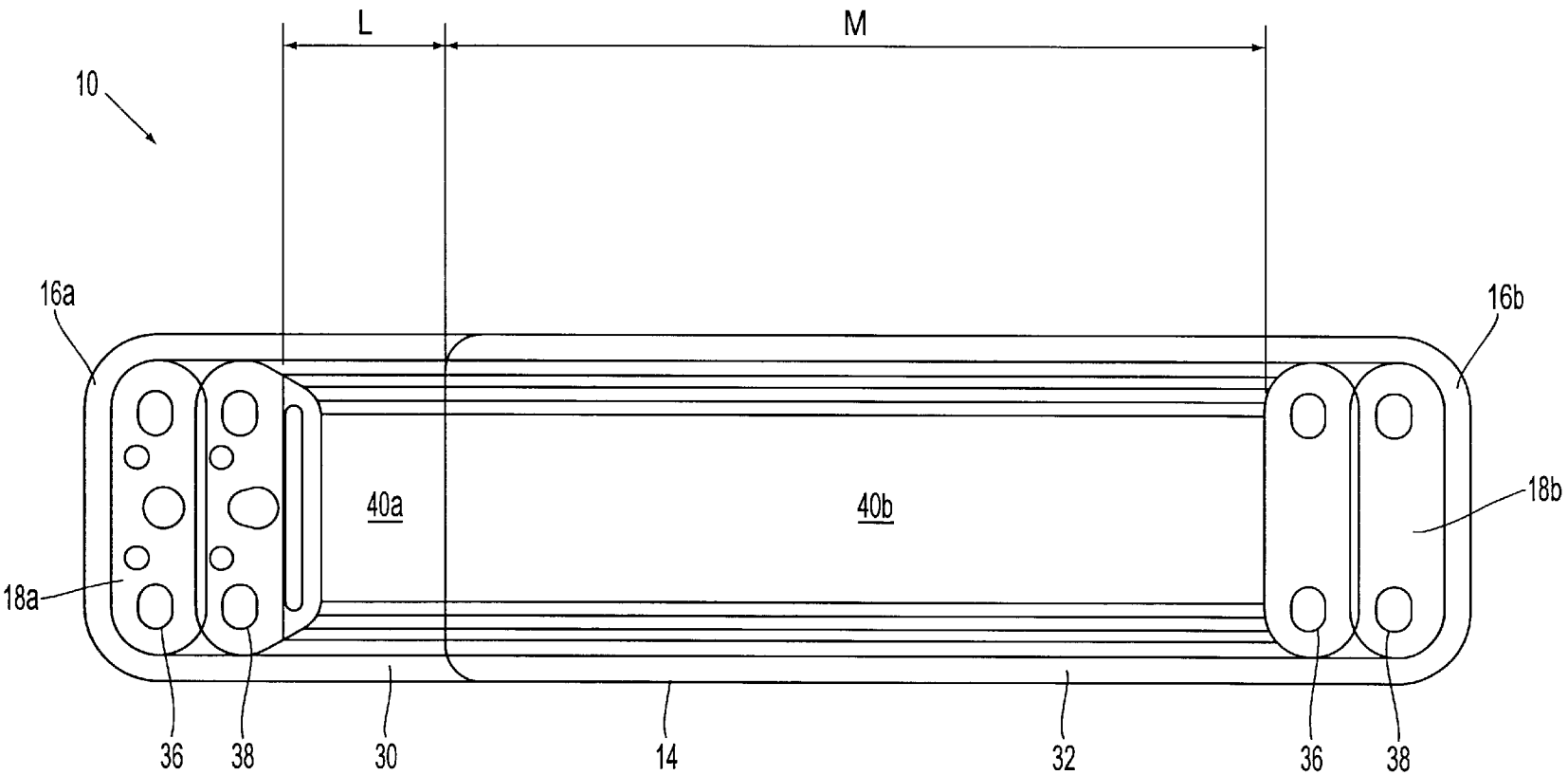
FIG. 3 shows a top view of the footstrap of FIG. 2.

FIG. 3 shows a top view of the footstrap 10 according to FIG. 2 with the supporting belt 34 not being shown.

Accordingly, in top view the footstrap 10 has a more or less rectangular cross-section with the fastening portions 16*a*, 16*b* configured in parallel to the standing face and the footstrap portion 22 extending asymmetrically towards the observer.

On the upper side of the supporting straps 30, 32 forming the insert 14 and turned towards the observer, a middle groove 40*a*, 40*b* is formed, the side walls of which rise in steps from the bottom of the groove to the side edges of the supporting straps 30, 32.

The middle grooves 40*a*, 40*b* are in, the relative position of the two supporting straps 30, 32 illustrated in FIG. 3, configured such that they merge into each other. Thus, a guiding groove is provided for the fastening means, for instance the fixing belt 34, which avoids lateral sliding off and thus ensures reliable fixing in position of the supporting straps 30, 32. By profiling the insert 32 with reinforced outer edges, the bending strength is improved in addition.

In the embodiment shown in FIG. 3, the assembling plates 18*a*, 18*b* each are configured in two parts. One-part assembling plates may, of course, also be used, as will still be explained in the following. The assembling plates 18*a*, 18*b* comprise assembling bore rows 36, 38 staggered in transverse direction (foot width), via which the width of the footstrap 10 can be adjusted. Instead of the staggered bore rows, elongated holes extending in transverse direction could also be used to enable the adjustibility of width.

The measures L, M are variables as a function of the length of the overlapping portion, so that the maximum (maximum rise from the standing face 8) can be adjusted both in height and in transverse position.

Figure 6:
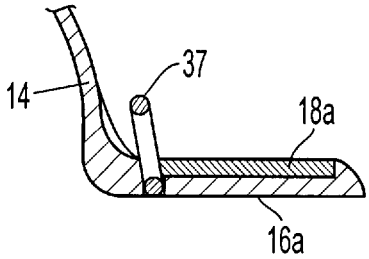
FIGS. 6 and 7 show detailed illustrations of the footstrap of FIG. 2.
Figure 7:
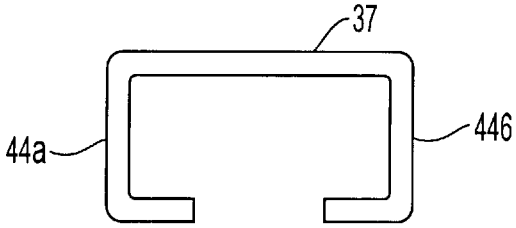

FIG. 6 shows a detailed section through a fastening portion 16*a*, the illustration of the padded portion 12 being renounced to simplify matters. As results therefrom, the D-ring 37 represented in FIG. 7 is configured with a more or less U-shaped transverse profile cross-section and surrounds the fastening portion 16*a* with the assembling plate 18*a*. In the latter one, a recess is formed into which the side legs 44*a*, 44*b* immerse at least partially, so that the D-rings 37 are anchored in the insert 14 via the assembling plate 18*a*. Basically, the D-ring 37 may also be configured integrally with one of the assembling plates 18*a*, 18*b*.

Figure 4:
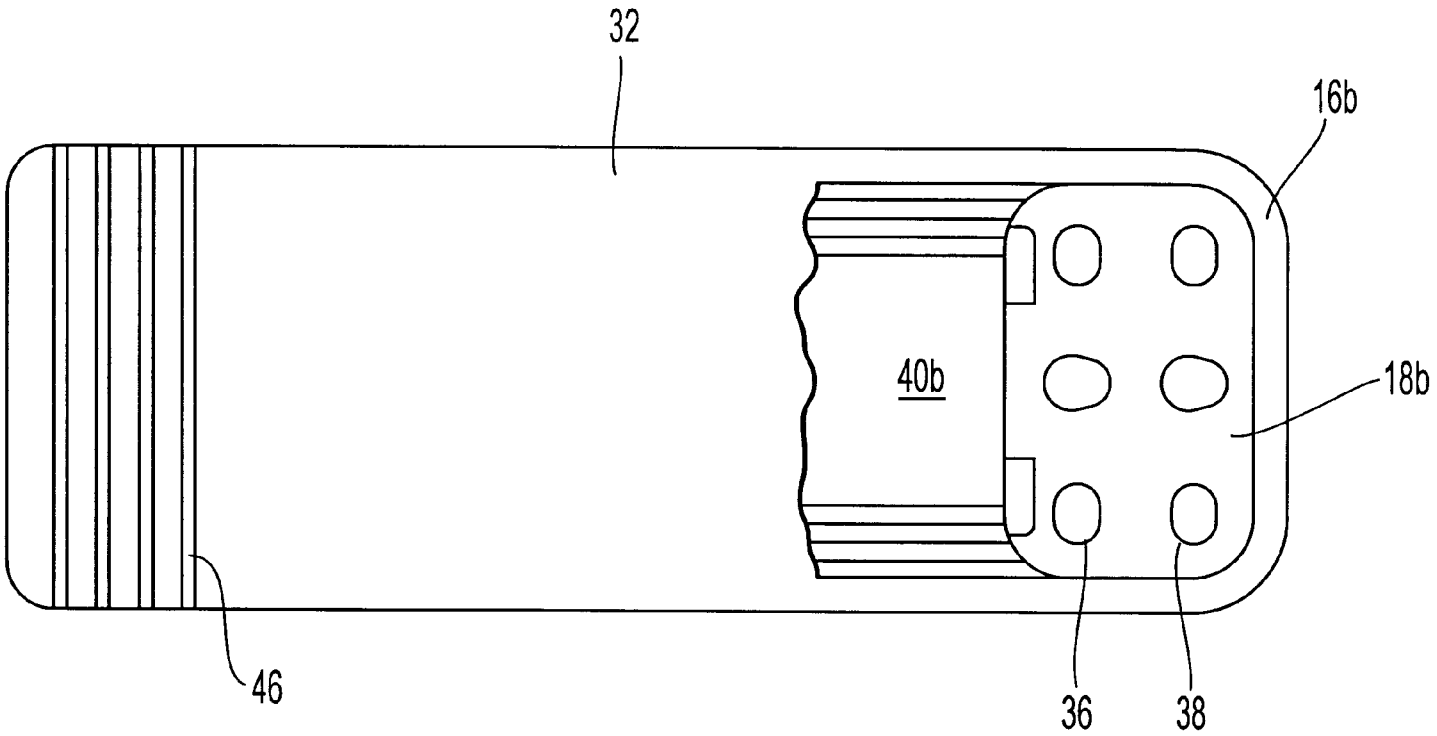
FIG. 4 shows a partial illustration of another embodiment of a footstrap for a sailboard according to FIG. 1.
Figure 5:
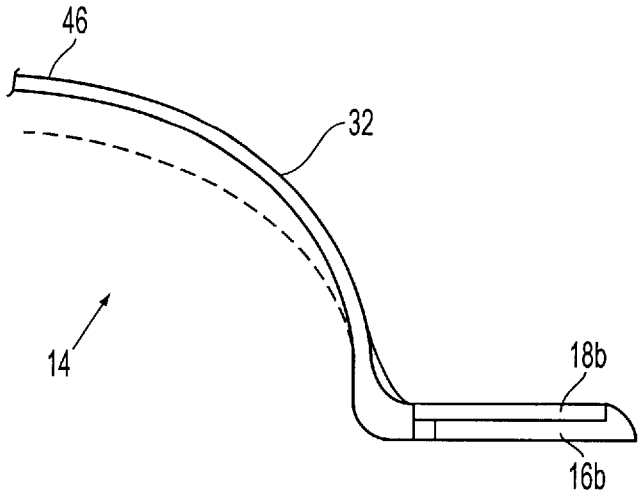
FIG. 5 shows a lateral view of the footstrap portion of FIG. 4.

FIGS. 4 and 5 show a supporting strap 32 of another embodiment of a footstrap 10 pursuant to the invention.

In the case of the embodiment described before, the fixing of the length of the overlapping area of the supporting straps 30, 32 was effected by corresponding adjustment of the fixing belt 34. Basically, the fixing means also could be arranged directly on the supporting straps 30, 32. Thus, these can for instance be connected with each other in the overlapping area by means of velcro fastening or the like.

In the embodiment shown in FIGS. 4 and 5, engaging grooves 46 are configured at the free end portion of the supporting strap 32 in the overlapping area, in which for instance correspondingly configured projections of the other supporting strap 30 may engage. It is also conceivable that a rattle clasp or a similar fixing element fixes the end portions of the two supporting straps 30, 32 relative to each other. Basically, it may also be advantageous to provide these engaging grooves in the initially described embodiment with a fixing belt 34, so that due to the increased friction in the overlapping area the relative position adjusted will be maintained in the case of loosening of the fixing belt 34, too.

What is essential with the invention is that, for the first time, a footstrap is provided which is adapted anatomically both in transverse direction and in longitudinal direction (relative to a foot of the surfer), so that contact over the entire face is guaranteed.

The footstrap need not necessarily be configured with dimensionally stable inserts 14, but these could also be formed by suitably fastened and stitched or deformed belt bands, respectively.

What is disclosed is a footstrap in which a portion bridging a surfer's foot is pre-shaped such that contact over the entire face with regular distribution of pressure on the foot is guaranteed.

What is claimed is:

1. A footstrap for a sailboard for holding the foot of a user, comprising:

a footstrap portion, the footstrap portion having a padded portion over which an insert extends at least partially, the insert formed of two parts and having an overlapping area in a middle portion of the insert;

two fastening portions (16*a,* 16*b*) that fasten the footstrap portion; and a contact face (24) of said footstrap portion (22) that is configured obliquely in longitudinal and transverse direction of the foot such that the footstrap portion rises from an inner foot-side fastening portion to a maximum and then drops off flatly towards another, outer foot-side fastening portion, and the contact face, even when the footstrap portion is not fastened, is pre-shaped to match the shape of a foot.

2. The footstrap according to claim 1, characterized in that the width or height of said footstrap portion (22) can be adjusted.

3. The footstrap according to claim 1, characterized in that a fixing belt (34) fixed in the area of the fastening portions (16*a*, 16*b*) extends over said insert (14, 30, 32).

4. The footstrap according to claim 1, characterized in that fastening means (46) are provided in the overlapping area of said two-part insert (14, 30, 32).

5. The footstrap according to claim 1, characterized in that said padded portion (12) consists of a foamed elastomer and said insert (14, 30, 3) consists of a moldable material.

6. The footstrap according to claim 1, characterized in that the profile of said padded portion (12) is predetermined by said insert (14).

7. The footstrap according to claim 1, characterized in that said fastening portions comprise assembling bore rows (36, 38) staggered in transverse direction of the foot or elongated holes extending in transverse direction.

* * * * *